US006059161A

United States Patent [19]

Chang et al.

[11] Patent Number: 6,059,161

[45] Date of Patent: May 9, 2000

[54] ASSEMBLY OF A POWER STAPLER

[75] Inventors: Hsin-Chun Chang; Arosun Lee, both of Taipei, Taiwan

[73] Assignee: Nailermate Enterprise Corporation, Taipei, Taiwan

[21] Appl. No.: 09/377,549

[22] Filed: Aug. 19, 1999

[51] Int. Cl.[7] ..... B25C 1/04

[52] U.S. Cl. ..... 227/8; 227/130

[58] Field of Search ..... 227/8, 130, 120

[56] References Cited

U.S. PATENT DOCUMENTS

| | | | |
|---|---|---|---|
| 5,551,621 | 9/1996 | Vallee | 227/130 |
| 5,692,663 | 12/1997 | Yang | 227/8 |
| 5,791,545 | 8/1998 | Lin | 227/130 |
| 5,797,533 | 8/1998 | Lee | 227/8 |
| 5,836,501 | 11/1998 | Lai | 227/8 |
| 5,862,969 | 1/1999 | Lee | 227/130 |

*Primary Examiner*—Scott A. Smith
*Attorney, Agent, or Firm*—Charles E Baxley, Esq.

[57] ABSTRACT

A trigger assembly for a power stapler includes a U-shaped trigger member pivotally connected to the power stapler and having two inclined and elongated slots in the two plates thereof. A pressing member has a flange extending from one of two surfaces thereof and an aperture is defined through the pressing member. The pressing member has two lugs so that the pressing member is pivotally between the two plates of the trigger member. A pin movably extends through the slots in the trigger member and the two lugs. The pressing member is slightly lifted within the slots when the piston rod of the power stapler inserted into the aperture for the single shoot so that the pressing member is not returned to its original position except the safety member is removed from the pressing member.

5 Claims, 5 Drawing Sheets

ASSEMBLY OF A POWER STAPLER

FIELD OF THE INVENTION

The present invention relates to a trigger assembly for a power stapler, and more particularly, to an improved trigger assembly wherein the trigger member has two inclined and elongated slots through which a pin extends and a pressing member is mounted to the pin. The pin is lifted upward to prevent the pressing member from returning to its original position when the user wants to shoot only one stapler each time.

BACKGROUND OF THE INVENTION

A conventional power stapler includes two functions one of which is single shoot and the other is continuous shoot. It is dangerous if the single shoot and the continuous shoot cannot be controlled with care. If the user thought it is a single shoot function, however, the staples shoot continuously then people could be injured by the powerful staples. Generally, the user has to push a safety member before each shoot so as to effectively let the stapler be injected from the power stapler. After a single shoot, if the pressing member connected to the trigger member is not firmly positioned at the expected position then, under some particular situations, the trigger could be unintentionally pulled again and the pressing member could push the valve rod again to shoot another staple.

The present invention intends to provide a trigger assembly which ensures the pressing member will not return to its original position after shooting except the safety member is removed from the pressing member. By this trigger assembly of the present invention, the single shoot will never be mis-activated.

SUMMARY OF THE INVENTION

In accordance with one aspect of the present invention, a trigger assembly for a power stapler is provided and comprises a trigger member having two plates with a pulling plate connected therebetween, and each plate having a first hole defined in a first end thereof and an inclined and elongated slot defined in a second end thereof. A pressing member has a flange extending from one of two surfaces thereof and an aperture is defined through the pressing member. Two lugs extend from two sides of the pressing member and each lug has a second hole defined therethrough. The pressing member is pivotally connected between the two plates of the trigger member by extending a pin through the slots in the trigger member and the second holes in the two lugs. Two torsion springs are mounted to the pin and biased between the pulling plate of the trigger member and the pressing member.

The main object of the present invention is to provide a trigger assembly wherein the pressing member has two inclined and elongated slots through which a pin extends so that when the piston rod is inserted into the aperture of the pressing member when pulling the trigger member, the pressing member is lifted slightly because of the elongated slots and the pressing member will not return to its original position except the safety member is not compress the pressing member.

Further objects, advantages, and features of the present invention will become apparent from the following detailed description with appropriate reference to the accompanying drawings.

DETAILED DESCRIPTION OF THE PREFERRED EMBODIMENT

Figure 1:
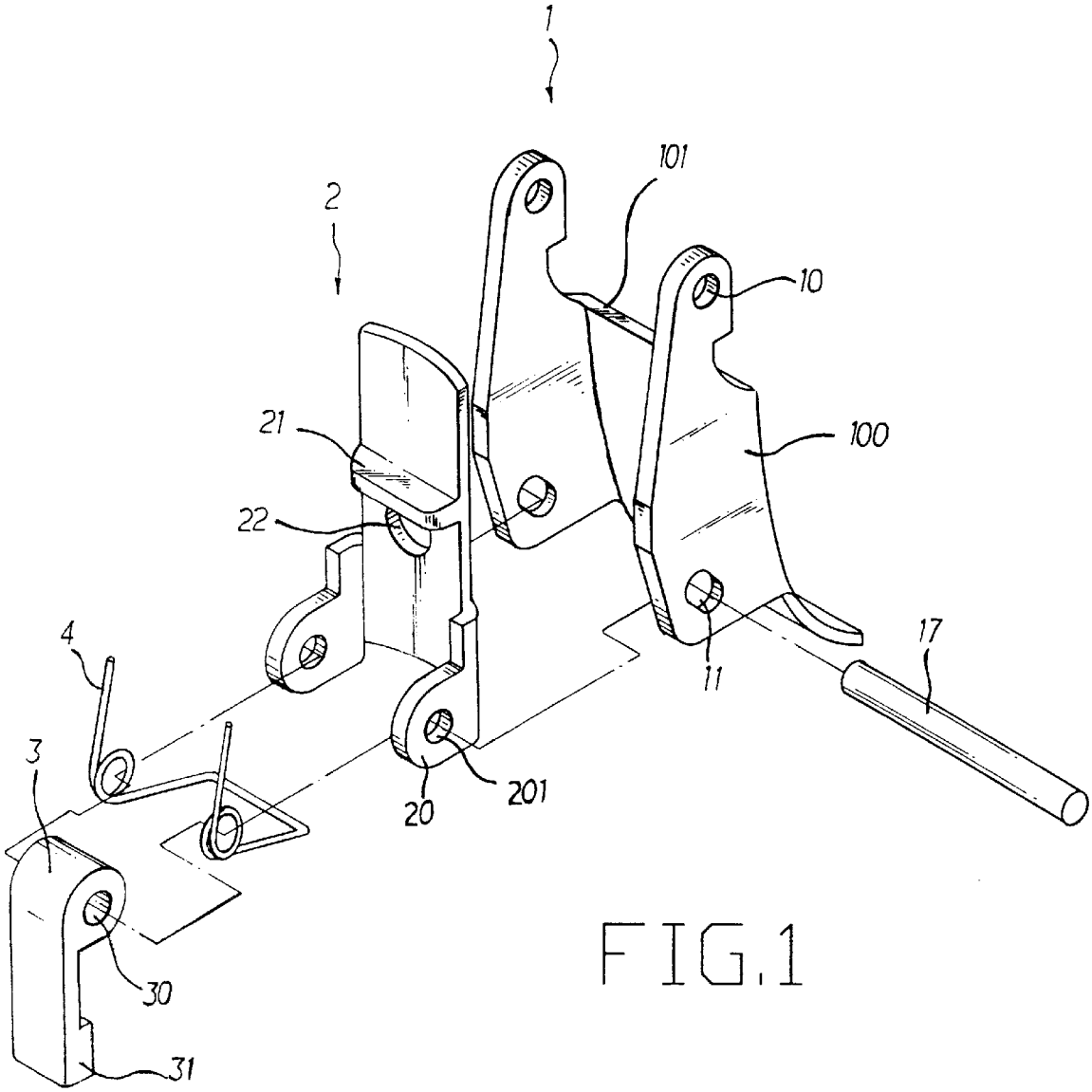
FIG. 1 is an exploded view of the trigger assembly in accordance with the present invention.
Figure 11:
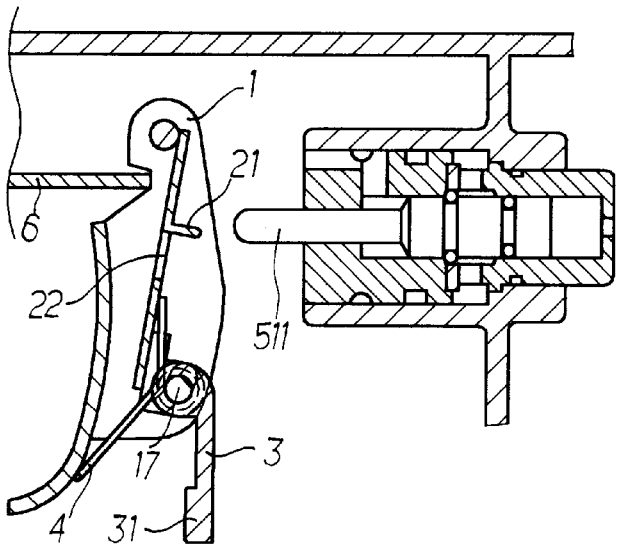
FIG. 11 is a side elevational view, partly in section, of the trigger assembly wherein the trigger member and the safety member are not pulled.

Referring to FIGS. 1 and 11, the trigger assembly for a power stapler, comprises a trigger member 1 having two plates 100 with a pulling plate 101 connected therebetween. Each plate 100 has a first hole 10 defined in a first end thereof so that the trigger member 1 is pivotally connected to the power stapler, and an inclined and elongated slot 11 defined in a second end thereof. A pressing member 2 has a flange 21 extending from one of two surfaces thereof and an aperture 22 is defined through the pressing member 2. The aperture 22 is located beneath the flange 21. Two lugs 20 extend from two sides of the pressing member 2 and each lug 20 has a second hole 201 defined therethrough. The pressing member 2 is pivotally connected between the two plates 100 of the trigger member 1 by extending a pin 17 through the slots 11 in the trigger member 1 and the second holes 201 in the two lugs 20. It is to be noted that the pin 17 is movably received in the slots 11.

Figure 8:
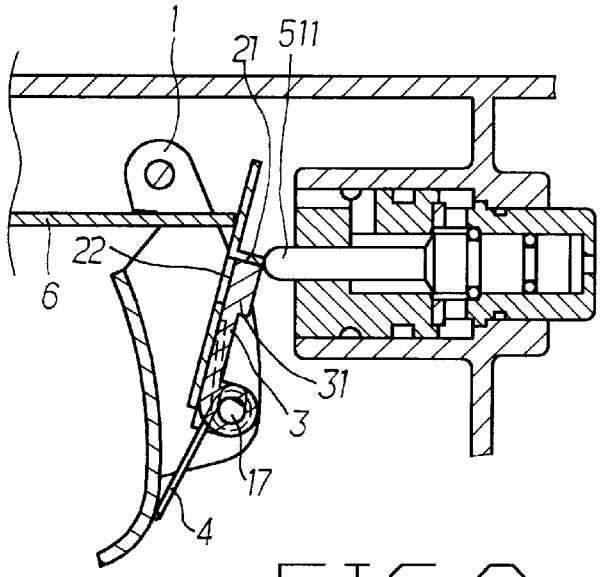
FIG. 8 is a side elevational view, partly in section, of the trigger assembly wherein the trigger member is pulled and the piston rod is pushed by the flange of the pressing member.
Figure 9:
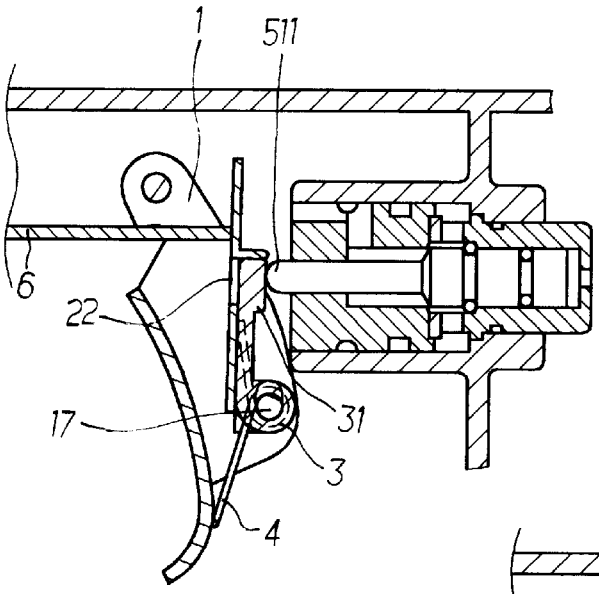
FIG. 9 is a side elevational view, partly in section, of the trigger assembly wherein the trigger member is pulled and the piston rod is stopped by the protrusion of the bar and not inserted into the aperture of the pressing member.
Figure 10:
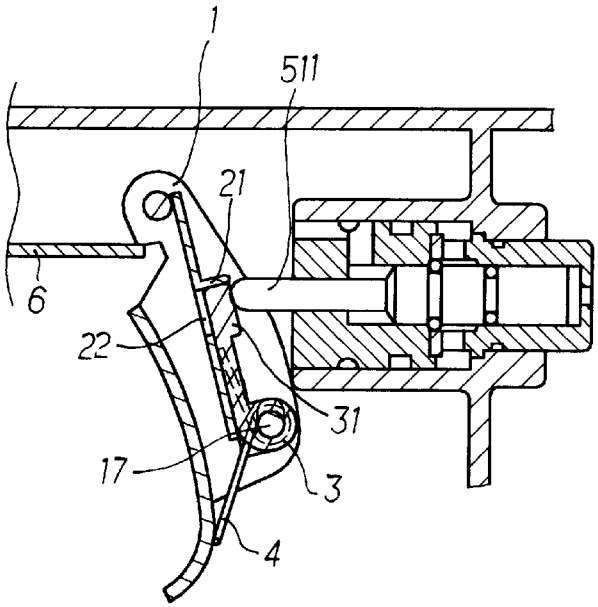
FIG. 10 is a side elevational view, partly in section, of the trigger assembly wherein the safety member is removed from the pressing member while the piston rod is stopped by the bar.

Two torsion springs 4 are mounted to the pin 17 and biased between the pulling plate 101 of the trigger member 1 and the pressing member 2. A bar 3 has a passage 30 defined through one of two ends thereof and the pin 17 extends through the passage 30 so that the bar 3 is located between the two lugs 20 of the pressing member 2. The length of the bar 3 is sized to close the aperture 22 in the pressing member 2 when pivoting the bar 3 toward and contacting the pressing member 2 as shown in FIGS. 8 to 10. The bar 3 has a protrusion 31 extending laterally from the second end thereof.

Figure 2:
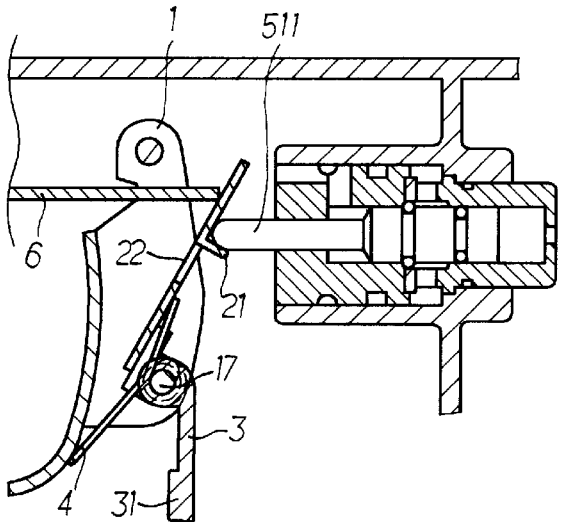
FIG. 2 is a side elevational view, partly in section, of the trigger assembly wherein the safety member is pushed to push the pressing member.
Figure 3:
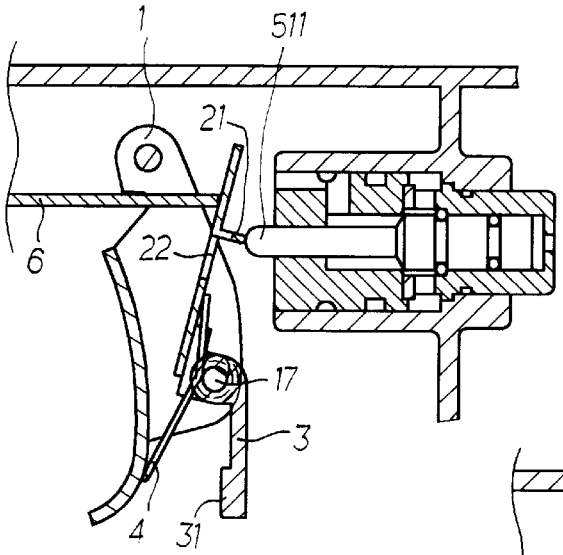
FIG. 3 is a side elevational view, partly in section, of the trigger assembly wherein the trigger member is pulled and the piston rod is pushed by the flange of the pressing member.
Figure 4:
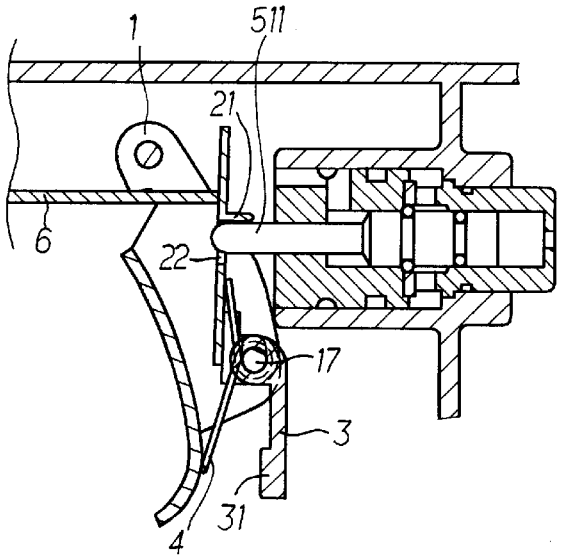
FIG. 4 is a side elevational view, partly in section, of the trigger assembly wherein the trigger member is completely pulled and the piston rod is inserted into the aperture in the pressing member.
Figure 5:
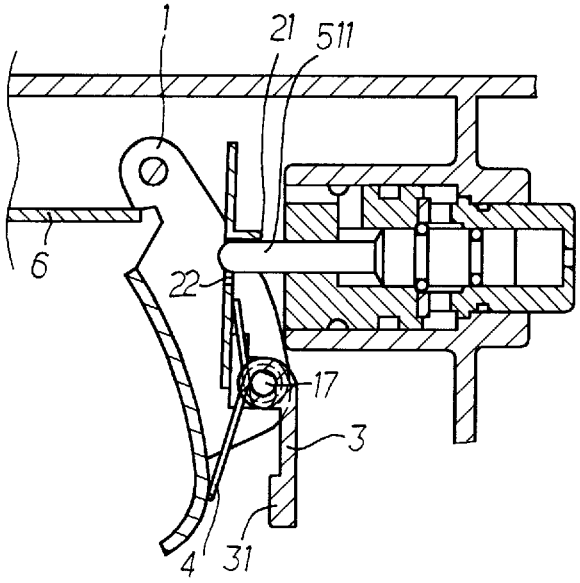
FIG. 5 is a side elevational view, partly in section, of the trigger assembly wherein the pressing member is slightly lifted upward when the trigger member is completely pulled.
Figure 6:
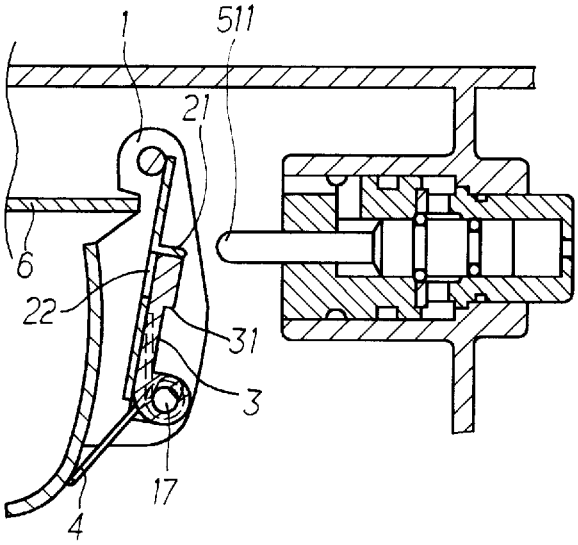
FIG. 6 is a side elevational view, partly in section, of the trigger assembly wherein the bar is pivoted to contact the pressing member.

Referring to FIGS. 2 to 4, when the user operates the power stapler to be single shoot status, the safety member 6 connected to the tip of the power stapler is first pushed to push the pressing member 2 to let the flange 21 be moved below the piston rod 511 as shown in FIG. 2. The trigger member 1 is then pulled to let the piston rod 511 is pushed by the pivotal movement of the flange 21 to let the piston activated to eject a staple as shown in FIG. 3. When the trigger member 1 is pulled, the piston rod 511 is inserted into the aperture 22 of the pressing member 2 and when the trigger member 1 is continuously pulled, the piston rod 511 will lift the pressing member 2 slightly because the elongated slots 11 as shown in FIG. 5.

Figure 7:
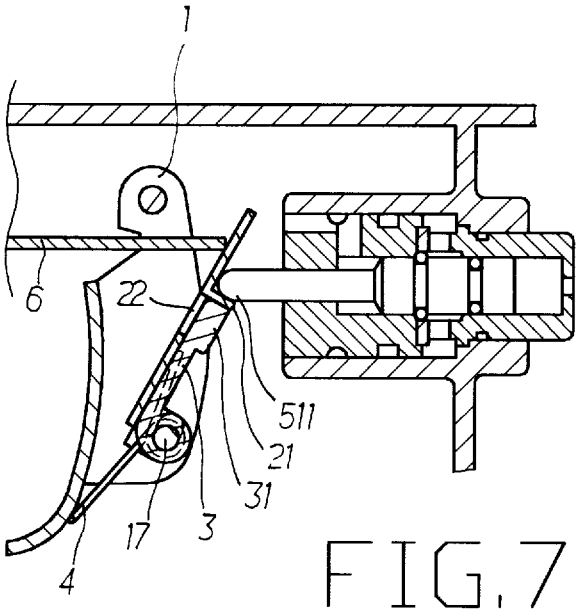
FIG. 7 is a side elevational view, partly in section, of the trigger assembly wherein the trigger member is pulled.

Referring to FIGS. 6 to 9, when the user operates the power stapler to be continuous shoot status, the bar 3 is first pivoted toward the pressing member 2 and closes the aperture 22. The protrusion 31 is in aligned with a distal edge of the flange 21 of the pressing member 2 or is slightly shorter than the distal edge of the flange 21 of the pressing member 2. The safety member 6 is then pushed to press the pressing member 2 as shown in FIG. 7 and then the piston rod 511 is pushed to eject a staple, wherein when the flange 21 moves over the piston rod 511, the piston rod 511 is stopped by the protrusion 31 and will not insert into the aperture 22 as shown in FIG. 9. When removing the power stapler from the object, the safety member 6 is removed from the pressing member 2, the pressing member 2 is then biased by the torsion springs 4 as shown in FIG. 10. Therefore, when the user pushes the safety member 6 again, the pressing member 2 is pushed to push the piston rod 511 to eject another staple, so that whenever the user pushes the tip of the power stapler to against the object, a staple is ejected.

Figure 12:
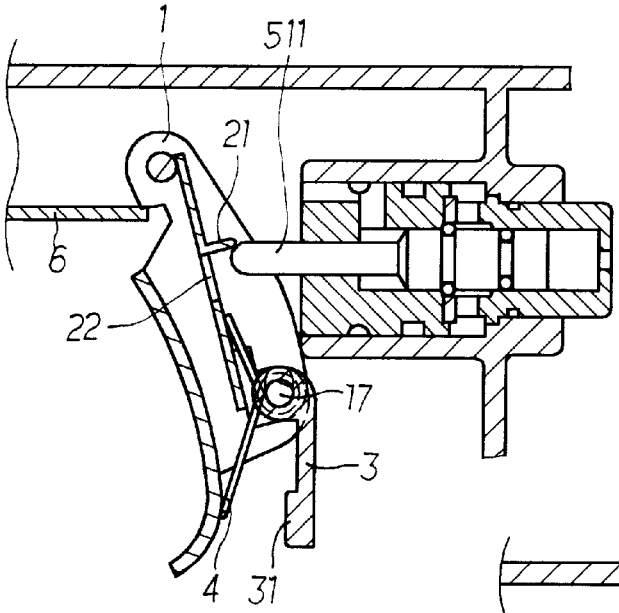
FIG. 12 is a side elevational view, partly in section, of the trigger assembly wherein the trigger member is pulled before the safety member is pushed.
Figure 13:
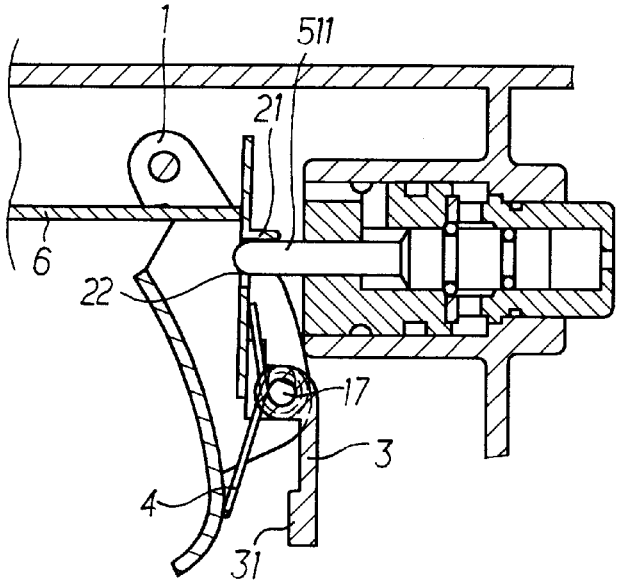
FIG. 13 is a side elevational view, partly in section, of the trigger assembly wherein the trigger member is completely pulled and the piston rod is inserted into the aperture in the pressing member without moving.

Referring to FIGS. 12 and 13, if a user pulls the trigger before the safety member 6 is pushed, the piston rod 511 is directly inserted into the aperture 22 so that even if the safety member 6 is pushed, because the piston rod 511 is retained in the aperture 22, the piston rod 511 will not be activated.

The elongated sots 11 of the trigger member 1 allows the pin 7 to be lifted slightly when the trigger member 1 is fully pulled so that the pressing member 2 is secured at this position and will not easily to return to its original position so that there will be no unexpected shooting.

The invention is not limited to the above embodiment but various modification thereof may be made. It will be understood by those skilled in the art that various changes in form and detail may made without departing from the scope and spirit of the present invention.

What is claimed is:

1. A trigger assembly for a power stapler, comprising:

a trigger member having two plates with a pulling plate connected therebetween, each plate having a first hole defined in a first end thereof and an inclined and elongated slot defined in a second end thereof;

a pressing member having a flange extending from one of two surfaces thereof and an aperture defined through said pressing member, two lugs extending from two sides of said pressing member and each lug having a second hole defined therethrough, said pressing member located between said two plates of said trigger member and a pin movably extending through said slots in said trigger member and said second holes in said two lugs, and two torsion springs mounted to said pin and biased between said pulling plate of said trigger member and said pressing member.

2. The trigger assembly as claimed in claim 1 further comprising a bar mounted to said pin and located between said two lugs of said pressing member.

3. The trigger assembly as claimed in claim 1, wherein the length of said bar is sized to close said aperture in said pressing member when pivoting said bar toward and contacting said pressing member.

4. The trigger assembly as claimed in claim 1, wherein said bar has a protrusion extending therefrom and said protrusion is located at an opposite end of said pin extending through said bar.

5. The trigger assembly as claimed in claim 4, wherein said protrusion is in aligned with a distal edge of said flange of said pressing member.

* * * * *